United States Patent [19]

Bartolotta et al.

[11] 3,933,672

[45] Jan. 20, 1976

[54] CONTROLLED SUDSING DETERGENT COMPOSITIONS

[75] Inventors: Guiseppe Bartolotta; Nicolaas Tieme de Oude; Alfred Alexander Gunkel, all of Brussels, Belgium

[73] Assignee: The Procter & Gamble Company, Cincinnati, Ohio

[22] Filed: July 23, 1973

[21] Appl. No.: 381,659

[30] Foreign Application Priority Data

Aug. 1, 1972 United Kingdom ..... 35877/72

[52] U.S. Cl. ..... 252/116; 252/89; 252/99; 252/131; 252/132; 252/134; 252/135; 252/140; 252/174; 252/321; 252/358

[51] Int. Cl.[2]... C11D 3/12; C11D 3/37; C11D 9/36; C11D 17/06

[58] Field of Search ..... 252/321, 358, 89, 99, 135, 252/134, 174, 116, 131, 132, 140

[56] References Cited

UNITED STATES PATENTS

| | | | |
|---|---|---|---|
| 2,806,001 | 9/1957 | Fong | 252/132 X |
| 3,235,509 | 2/1966 | Nitzsche | 252/358 |
| 3,329,625 | 7/1967 | Hoxie | 252/358 |
| 3,455,839 | 7/1969 | Rauner | 252/321 |
| 3,703,470 | 11/1972 | Brennan | 252/99 |
| 3,812,044 | 5/1974 | Connor | 252/89 |
| 3,829,386 | 8/1974 | Wegst | 252/135 |
| 3,843,558 | 10/1974 | Farminer | 252/358 |

FOREIGN PATENTS OR APPLICATIONS

| | | | |
|---|---|---|---|
| 525,433 | 5/1956 | Canada | 252/358 |

*Primary Examiner*—Dennis E. Talbert, Jr.
*Assistant Examiner*—Dennis L. Albrecht
*Attorney, Agent, or Firm*—J. J. Yetter; C. R. Wilson; F. L. Collins

[57] ABSTRACT

Detergent compositions having an effective suds controlling agent comprising a silicone material which is substantially removed from contact with the surfactant component of the composition.

22 Claims, No Drawings

CONTROLLED SUDSING DETERGENT COMPOSITIONS

BACKGROUND OF THE INVENTION

The present invention relates to detergent compositions containing as an essential ingredient a silicone suds controlling agent which is stable on storage. The concept of "stability" as used herein is in the context of protecting the silicone and preserving, maintaining or promoting its capability of suppressing or controlling the suds profile of a detergent surface active agent. More specificially, the invention in its broadest context encompasses detergent compositions comprising a detersive surfactant component and a silicone suds controlling agent which is separated or isolated within a protective matrix from the detersive surfactant.

In many industrial and household detergent operations involving aqueous solutions the formation of excessive suds is highly objectionable. Many prior art detergent compositions are high sudsing products. When such compositions are used in laundry washing machines, and especially in automatic dishwashers, they suds profusely and may cause the machines to overflow. Moreover, in horizontal tumbler-type washing machines, excess suds decrease the washing action by interfering with the free fall of the fabrics. A consequence may be that excessive suds or suds overflow may cause damage to the machine or may cause the user to compensate for excessive suds formation by using less detergent composition than is desirable to achieve good cleaning. On the other hand, users of detergent compositions for washing by hand, usually at lower temperatures, normally expect a certain amount of suds to be present at least until the detergent solution is so loaded with soil that it is no longer effective for cleaning. Thus, for some applications, such as automatic dishwashing, minimum suds formation is desirable; for so-called light-duty or fine fabric hand laundering a moderate suds level is useful; whereas a generous, but not excessive, suds blanket has come to be expected with so-called heavy-duty laundry compositions for washing heavily soiled fabrics. Adapting or controlling the suds profile of a detergent composition in these different applications has been a technical formulating challenge.

It is known that the sudsing of many prior art detergent compositions can be controlled by means of suds depressants such as long chain fatty acids, long chain fatty alcohols, esters and/or ethers thereof, or fatty acid amines and amides. Many of these suds depressants appear to have an adverse effect upon the whiteness maintenance properties of the detergent compositions and most are only useful and effective at lower temperatures. Moreover, many of such prior art materials are sensitive to water hardness; some cannot be used because of their interaction with washing additives; and some interact adversely with the soil or are ineffective under alkaline conditions.

Silicones are widely known and taught for use as highly effective suds controlling agents. For example, U.S. Pat. No. 3,455,839 relates to compositions and processes for defoaming aqueous solutions by incorporating therein small amounts of polydimethylsiloxane fluids.

Useful suds controlling silicones are mixtures of silicone and silanated silica as described, for instance, in German Pat. Application DOS 2,124,526.

Additionally, German Pat. No. 2,232,262 relates to silicone suds controlling agents comprising sodium tripolyphosphate surface-coated with an organopolysiloxane.

Although silicone defoamers and suds controlling agents have been known for many years, such materials have not heretofore been successfully incorporated into a detergent composition. Rather, the silicones are characteristically used once the detergent composition has already been added to the aqueous cleaning bath. This, of course, is not desirable, nor always feasible, since the user is not predisposed to add such materials separately to a fabric laundering bath or automatic dishwasher. Accordingly, it would be desirable to provide detergent compositions containing a stable silicone suds controlling agent as an integral ingredient.

A variety of means have been suggested for employing silicones in combination with detergent compositions. For example, it would be expected that such material could simply be sprayed onto, or otherwise admixed, with a detergent composition to provide the desired suds control. However, simple admixture of a silicone with a detergent composition has been shown experimentally not to be a satisfactory means for providing the suds controlling function. While such silicone-containing compositions initially exhibit a controlled suds, the suds control property of the silicone is very significantly reduced or perhaps even completely lost during storage of the composition for even relatively short periods. For this reason, attempts have been made to stabilize or protect the silicones in the detergent compositions, for example by sorption on a carrier material (see German Pat. No. 2,232,262, above). However, experiments have shown that adsorbing a silicone on a porous carrier does not provide detergent compositions having a substantial foam controlling action after storage.

It has now been found that the problem with formulating stable, controlled sudsing detergent compositions containing silicones arises from an interaction between the detersive surfactant (i.e., detergent) component of such mixtures and the silicone suds controlling agent. While the exact mechanism is not known, it appears that, on storage, the surfactant component interacts with the silicone to render it water-dispersible. On admixture of the detergent composition with water, the silicone is dispersed throughout the aqueous liquor rather than migrating to the air/water interface. Accordingly, the silicone cannot perform its desired suds controlling function.

Having recognized the problem of the heretofore unsuspected interaction of the detergent material with the silicone on storage, it has now been found that by isolating the silicone material from said detergent, compositions having controlled suds patterns even after prolonged storage can be provided.

Accordingly, it is an object of this invention to provide detergent compositions having a controlled suds pattern. (By "controlled suds pattern" herein is meant a suds height which is substantially zero in an automatic dishwashing composition, and which is low-to-medium in height over a broad temperature range in the case of hand- and machine-laundering products.)

It is further object herein to provide compositions and processes for incorporating silicone suds controlling agents in detergent compositions such that effective suds control is obtained even after prolonged storage.

These and other objects are obtained herein, as will be seen from the following disclosure.

SUMMARY OF THE INVENTION

The present invention encompasses detergent compositions having a controlled suds pattern, comprising:

i. a suds suppressing amount of a stable suds controlling component especially adapted for use in a detergent composition, comprising a silicone suds controlling agent releasably incorporated in a water-soluble or water-dispersible, substantially non-surface active, detergent-impermeable carrier; and ii. a detergent component selected from the group consisting of anionic, nonionic, zwitterionic, ampholytic and cationic detergents.

The silicone suds controlling component of the instant compositions is employed herein in a "suds suppressing amount". By "suds suppressing amount" is meant that the formulator of the compositions can select an amount of this component which will control the suds to the extent desired. For example, for use in automatic dishwashers, a suds height of zero is desirable; accordingly relatively more of the suds controller will be used. For hand dishwashing, relatively less suds controller will be used. The amount of suds controller will also vary with the detergent component selected. For example, with high sudsing surfactants, relatively more of the controller is used to achieve the desired suds control than when low foaming detergents are selected for use in the compositions herein.

The silicone suds controlling component herein comprises a silicone suds controlling agent of the type hereinafter disclosed which is substantially isolated from the detergent component of the composition. This "isolation" is achieved by incorporating the silicone agent in a water-soluble or water-dispersible carrier matrix. Of course, the matrix, itself, must be a substantially non-surface active material which does not, itself, interact with the silicone agent in the manner disclosed above. Moreover, the carrier must be substantially impenetrable by the detergent component of the detergent composition to prevent such undesirable silicone/detergent interaction. For example, simply sorbing the silicone agent onto and into a porous carrier matrix does not suffice to prevent interactions with the detergent component on storage. It is only when the silicone is substantially fully isolated from the detergent that stable compositions are secured.

Moreover, the carrier matrix herein must not contain added surface active agents, other than the silicone. For example, British Pat. No. 892,787 suggests that encapsulated silicone defoamers can be prepared by encapsulating a silicone in a film-forming material. The patent teaches that surfactants can be mixed directly and intimately with the silicone and encapsulating material to provide a homogeneous dispersion which can be spray-dried to granular form. However, such surfactant-containing granules are not contemplated for use herein due to stability problems occasioned by the intimate contact of the silicone and surfactant within the granule during storage before use. Accordingly, the carriers herein must be surfactant-free.

DETAILED DESCRIPTION OF THE INVENTION

The compositions of the present invention comprise two essential components, the silicone suds controlling component and the detergent component. In order to provide a stable composition which provides good suds control even after storage, it is necessary to isolate the silicone component from the detergent component in the manner hereinafter disclosed. The individual components of the compositions herein are described in detail, below.

Suds Controlling Component

The suds controlling component of the instant compositions comprises a silicone suds controlling agent which is incorporated in a water-soluble or water-dispersible, substantially non-surface active, detergent-impermeable carrier material. The carrier material contains within its interior substantially all the silicone suds controlling agent and effectively isolates it, i.e., keeps it out of contact, from the detergent component of the compositions. The carrier material is selected such that, upon admixture with water, the carrier matrix dissolves or disperses to release the silicone material incorporated therewith to perform its suds controlling function.

The silicone materials employed as the suds controlling agents herein can be alkylated polysiloxane materials of several types, either singly or in combination with various solid materials such as silica aerogels and xerogels and hydrophobic silicas of various types. In industrial practice, the term "silicone" has become a generic term which encompasses a variety of relatively high molecular weight polymers containing siloxane units and hydrocarbyl groups of various types. In general terms, the silicone suds controllers can be described as siloxanes having the general structure $$-\left(\begin{array}{c} R \\ | \\ Si \\ | \\ R' \end{array}O\right)-_x$$

wherein $x$ is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Silicone materials are commercially available from the Dow Corning Corporation under the trade name Silicone 200 Fluids.

Additionally, other silicone materials wherein the side chain groups R and R′ are alkyl, aryl, or mixed alkyl and aryl hydrocarbyl groups exhibit useful suds controlling properties. These materials are readily prepared by the hydrolysis of the appropriate alkyl, aryl or mixed alkylaryl silicone dichlorides with water in the manner well known in the art. As specific examples of such silicone suds controlling agents useful herein there can be mentioned, for example, diethyl polysiloxanes; dipropyl polysiloxanes; dibutyl polysiloxanes; methylethyl polysiloxanes; phenylmethyl polysiloxanes; and the like. The dimethyl polysiloxanes are particularly useful herein due to their low cost and ready availability.

A second type of silicone suds controlling agent useful in the compositions herein comprises a mixture of an alkylated siloxane of the type hereinabove disclosed and solid silica. Such mixtures of silicone and silica can be prepared by affixing the silicone to the surface of silica ($SiO_2$), for example by means of the catalytic reaction disclosed in U.S. Pat. No. 3,235,509. Suds controlling agents comprising mixtures of silicone and silica prepared in this manner preferably comprise silicone and silica in a silicone:silica ratio of from 19:1 to 1:2, preferably 10:1 to 1:1. The silica can be chemically and/or physically bound to the silicone in an amount which is preferably about 10 to 15% by weight, based on the silicone. The particle size of the silica employed in such silica/silicone suds controlling agents should preferably be not more than 100 millimicrons, preferably from 10 millimicrons to 20 millimicrons, and the specific surface area of the silica should exceed about 50 $m^2/g$.

Alternatively, suds controlling agents comprising silicone and silica can be prepared by admixing a silicone fluid of the type hereinabove disclosed with a hydrophobic silica having a particle size and surface area in the range disclosed above. Any of several known methods may be used for making a hydrophobic silica which can be employed herein in combination with a silicone as the suds controlling agent. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is secured.

In an alternate procedure, a hydrophobic silica useful in the present compositions and processes is obtained by contacting silica with any of the following compounds: metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred suds controlling agent herein comprises a hydrophobic silanated (most preferably trimethylsilanated) silica having a particle size in the range from about 10 to 20 millimicrons and a specific surface area above about 50 $m^2/g$ intimately admixed with a dimethyl silicone fluid having a molecular weight in the range of from about 500 to about 200,000, at a weight ratio of silicone to silanated silica of from about 19:1 to about 1:2. Such suds controlling agents preferably comprise silicone and the silanated silica in a weight ratio of silicone:silanated silica of from 10:1 to 1:1. The mixed hydrophobic silanated (especially trimethylsilanated) silica-silicone suds controlling agents provide suds control over a broad range of temperatures, presumably due to the controlled release of the silicone from the surface of the silanated silica.

Another type of suds control agent herein comprises a silicone material of the type hereinabove disclosed sorbed onto and into a solid. Such suds controlling agents comprise the silicone and solid in a silicone:solid ratio of from about 20:1 to about 1:20, preferably about 5:1 to about 1:1. Examples of suitable solid sorbents for the silicones herein include sodium carbonate, sodium tripolyphosphate, any of the sodium silicates, clay, starch, kieselguhr, Fuller's Earth, and the like. The alkalinity of the solid sorbents is of no consequence to the compositions herein, inasmuch as it has been discovered that the silicones are stable when admixed therewith. As disclosed hereinabove, the sorbent-plus-silicone suds controlling agent must be coated or otherwise incorporated into a carrier material of the type hereinafter disclosed to effectively isolate the silicone from the detergent component of the instant compositions.

Yet another type of silicone suds controlling agent herein comprises a silicone fluid, a silicone resin and silica. The silicone fluids useful in such suds controlling mixtures are any of the types hereinabove disclosed, but are preferably dimethyl silicones. The silicone "resins" used in such compositions can be any alkylated silicone resins, but are usually those prepared from methylsilanes. Silicone resins are commonly described as "three-dimensional" polymers arising from the hydrolysis of alkyl trichlorosilanes, whereas the silicone fluids are "two-dimensional" polymers prepared from the hydrolysis of dichlorosilanes. The silica components of such compositions are the microporous materials such as the fumed silica aerogels and xerogels having the particle sizes and surface areas hereinabove disclosed.

The mixed silicone fluid/silicone resin/silica materials useful in the present composition can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

a. from about 10 parts to about 100 parts by weight of a polydimethylsiloxane fluid having a viscosity in the range from 20 cs. to 1500 cs. at 25°C;
b. 5 to 50 parts by weight of a siloxane resin composed of $(CH_3)_3SiO_{1/2}$ units and $SiO_2$ units in which the ratio of the $(CH_3)_3SiO_{1/2}$ units to the $SiO_2$ units is within the range of from 0.6/1 to 1.2/1; and
c. 1 to 10 parts by weight of a silica aerogel.

Such mixtures can also be sorbed onto and into a water-soluble solid as disclosed above.

Again, such mixed silicone resin/silica suds controlling agnets must be combined with a detergent-impermeable carrier material to be useful in the compositions herein.

The silicone suds controlling agents of the aforementioned type must be incorporated within (i.e., coated, encapsulated, covered by, internalized, or otherwise substantially contained within) a water-soluble or water-dispersible carrier material which must be impermeable to detergents and which, itself, must be substantially non-surface active. By substantially non-surface active is means that the carrier material, itself, does not interact with the silicone material in such fashion that it is emulsified or otherwise excessively dispersed throughout an aqueous medium, rather than at the air/water interface.

Of course, when preparing a dry powder or granulated detergent composition it is preferable that the silicone suds controlling component thereof also be substantially dry and non-tacky at ambient temperatures. Accordingly, it is preferred herein to use as the carrier material or vehicle plastic, organic compounds which can be conveniently melted, admixed with the silicone suds controlling agent, and thereafter cooled to form solid powders, granules or prills. There are a wide variety of such carrier materials useful herein. Since the silicone suds controlling agent is to be releasably incorporated in the carrier, such that the silicone is released into the aqueous bath upon admixture of the composition therewith, it is preferred that the carrier material be water-soluble. However, water-dispersible materials are also useful, inasmuch as they will also release the silicone upon addition to an aqueous bath.

A wide variety of carrier materials having the requisite solubility/dispersibility characteristics and the essential features of being non-surface active and detergent-impermeable are known. For example, the high molecular weight carbowaxes which have substantially no surface active characteristics are useful herein. Examples of this type of material include the polyethyleneglycols having a molecular weight of from about 1,500 to about 10,000, especially about 4,000. Surprisingly, highly ethoxylated fatty alcohols such as tallow alcohol condensed with about 25 molar proportions of ethylene oxide are useful herein. Other alcohol condensates containing extremely high ethoxylate proportions (ca. 25 and above) are also useful herein. Such high ethoxylates apparently lack sufficient surface active characteristics to interact or otherwise interfere with the desired suds control properties of the silicone agents herein. A particularly preferred ethoxylated carrier material herein is tallowalcohol condensed with about 25 molar proportions of ethylene oxide, and abbreviated $TAE_{25}$.

A variety of other materials useful as the carrier agents herein may also be mentioned: gelatin; agar; gum arabic; and various algae-derived gels.

The silicone suds controlling component of the present invention can be conveniently prepared by admixing or spraying the silicone suds controlling agent with a carrier material to form a granular product. Conveniently, a melt of carrier material and silicone suds controlling agent is prepared and sprayed in a cooling tower to form droplets comprising the carrier material with the silicone suds controlling agent releasably incorporated therein. When this procedure is used, the silicone suds controlling agent is contained within the carrier material so effectively that when this material is eventually admixed with or incorporated into a detergent composition, the silicone does not substantially come into contact with the detergent surfactant ingredient.

In order to provide a granular, non-tacky suds controlling component useful in dry granular detergent compositions, the composite of the silicone suds controlling agent and carrier material should be substantially solidified. This can be achieved by use of long drying towers or rapid refrigeration processes which quickly cool the droplets such that the carrier melt is hardened. However, such procedures are not preferred in an industrial process because of extra plant requirements.

It has been discovered that a rapid and effective way for solidifying a carrier melt containing the silicone suds controlling agent is by spraying the carrier melt into and onto a fluidized bed of a solid, preferably water-soluble material to form coated granules. The resulting coated granules of suds controlling component are crisp and free-flowing, and are especially adapted for use in detergent compositions.

Any type of powdered material is useful to form a fluidized bed suitable for cooling and coating the spray-dried melts herein. Of course, it is particularly suitable to choose dry powders which are useful per se in detergent compositions for their builder, soil-suspending, softening, and the like properties. Specific examples of suitable powdered coating materials useful in the fluidized bed processes herein include, for example, sodium tripolyphosphate, sodium carbonate, sodium carboxymethylcellulose, granulated starch, clay, sodium citrate, sodium acetate, sodium sulfate, and the like. The particle size of such coating materials is in no way limited but must be such that a fluidized bed can be conveniently secured. In general, particle size range will be from about 0.1 micron to about 100 microns.

It is to be recognized that the amount of carrier used to isolate the silicone suds controlling agent herein from the detergent component of the compositions herein is not critical. It is only necessary that enough carrier be used to provide sufficient volume that substantially all the silicone can be incorporated therein. Likewise, it is preferred to have sufficient carrier material to provide for sufficient strength of the resultant granule to resist premature breakage. Generally, above about a 2:1 weight ratio of carrier to silicone suds controlling agent is employed.

Likewise, the amount of solid powder material which optionally coats the carrier-plus-silicone granule is not critical. For most purposes, sufficient powder is employed to substantially coat the mixture of carrier having the silicone incorporated therein with one or two layers of the powder. In addition to cooling and solidifying the carrier, the particulate coating material provides additional protection from the detergent component of the compositions, but it is not essential for this purpose.

Accordingly, the present invention encompasses detergent compositions comprising a detergent component and a suds controlling component comprising a prill or bead consisting essentially of from about 0.1 to about 99% by weight of a silicone suds controlling agent of any of the types hereinabove disclosed and from about 0.1 to about 99% by weight of a carrier material of the type hereinabove disclosed. The invention also encompasses such compositions wherein the prill is substantially coated with a water-soluble or water-dispersible particulate solid.

The size of the particles of the suds controlling component used in the present compositions is not critical to their use and performance characteristics. In general, spray-drying processes result in particles in a size of from about 1 micron to about 1000 microns in diameter; the prills can be made to match these dimensions.

Detergent compositions comprising the suds control component and the detergent component can be provided having various ratios and proportions of these two materials. Of course, the amount of the suds control component can be varied, depending upon the suds profile desired by the formulator. Moreover, the amount of detergent component can be varied to provide either heavy duty or light duty products, as desired.

For most purposes, it is preferred to use a sufficient amount of the silicone suds controlling component in the detergent composition to provide a concentration of from about 0.01 to about 10% by weight of the silicone suds controlling agent in the composition. A preferred amount of silicone suds controlling agent in the detergent composition lies within the range of from 0.01 to 0.5% by weight. Accordingly, the amount of suds control component will be adjusted, depending upon the amount of silicone suds control agent contained therein, to provide these desirable percentages of suds control agent.

The amount of the detergent component can, as noted hereinabove, vary over a wide range which depends on the desires of the user. In general, the compositions contain from about 5 to about 95%, preferably about 10 to about 30% by weight, of detergent.

Detergent Component

The detergent compositions of the instant invention can contain all manner of organic, water-soluble detergent compounds inasmuch as the silicone suds control agents are isolated therefrom. A typical listing of the classes and species of detergent compounds useful herein appear in U.S. Pat. No. 3,664,961, incorporated herein by reference. The following list of detergent compounds and mixtures which can be used in the instant compositions is representative of such materials, but is not intended to be limiting.

Water-soluble salts of the higher fatty acids, i.e., "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergents includes water-soluble salts, particularly the alkali metal, ammonium and alkylolammonium salts, or organic sulfuric reaction products having in their molecular structure an alkyl group containing from about 8 to 22 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms, in straight chain or branched chain configuration, e.g. those of the type described in U.S. Pat. Nos. 2,220,099 and 2,477,383. Especially valuable are linear straight chain alkyl benzene sulfonates in which the average of the alkyl groups is about 12 carbon atoms, abbreviated as $C_{12}$ LAS.

Other anionic detergent compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be easily adjusted to yield a water-soluble compound having the desired degree of balance between hydrophilic and hydrophobic elements.

For example, a well-known class of nonionic synthetic detergents is made available on the market under the trade name of "Pluronic." These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g., a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water solubilizing group. The quaternary compounds, themselves, e.g. cetyltrimethyl ammonium bromide, can also be used herein.

Other useful detergent compounds herein include the water-soluble salts of esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble organic detergent compounds herein include linear alkyl benzene sulfonates containing from about 11 to 14 carbon atoms in the alkyl group; the tallow range alkyl sulfates; the coconut alkyl glyceryl sulfonates; alkyl ether sulfates wherein the alkyl moiety contains from about 14 to 18 carbon atoms and wherein the average degree of ethoxylation varies between 1 and 6; the sulfated condensation products of tallow alcohol with from about 3 to 10 moles of ethylene oxide; olefin sulfonates containing from about 14 to 16 carbon atoms; alkyl dimethyl amine oxides wherein the alkyl group contains from about 11 to 16 carbon atoms; alkyldimethyl-ammonio-propane-sulfonates and alkyl-dimethyl-ammonio-hydroxy-propane-sulfonates wherein the alkyl group in both types contains from about 14 to 18 carbon atoms; soaps, as hereinabove defined; the condensation product of tallow fatty alcohol with about 11 moles of ethylene oxide; and the condensation product of a $C_{13}$ (avg.) secondary alcohol with 9 moles of ethylene oxide.

Specific preferred detergents for use herein include: sodium linear $C_{10}$–$C_{18}$ alkyl benzene sulfonate; triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalalkylammonio)-2-hydroxypropane-1-sulfonate; 3-(N,N-dimethyl-N-coconutalkylammonio-propane-1-sulfonate; 6-(N-dodecylbenzyl-N,N-dimethylammonio)hexanoate; dodecyl dimethyl amine oxide; coconut alkyl dimethyl amine oxide; and the water-soluble sodium and potassium salts of higher fatty acids containing 8 to 24 carbon atoms.

It is to be recognized that any of the foregoing detergents can be used separately herein or as mixtures. Examples of preferred detergent mixtures herein are as follows.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide; see copending application of Jocobsen and Krummel, Ser. No. 306,330, filed Nov. 13, 1972, incorporated herein by reference.

Specifically, such preferred mixtures comprise from about 0.05 to 5% by weight of mixture of $C_{12\text{-}13}$ compounds, from about 55 to 70% by weight of mixture of $C_{14\text{-}15}$ compounds, from about 25 to 40% by weight of mixture of $C_{16\text{-}17}$ compounds and from about 0.1 to 5% by weight of mixture of $C_{18\text{-}19}$ compounds. Further, such preferred alkyl ether sulfate mixtures comprise from about 15 to 25% by weight of mixture of compounds having a degree of ethoxylation of 0, from about 50 to 65% by weight of mixture of compounds having a degree of ethoxylation from 1 to 4, from about 12 to 22% by weight of mixture of compounds having a degree of ethoxylation from 5 to 8 and from about 0.5 to 10% by weight of mixture of compounds having a degree of ethoxylation greater than 8.

Examples of alkyl ether sulfate mixtures falling within the above-specified ranges are set forth in Table I.

TABLE I

| MIXTURE CHARACTERISTIC | ALKYL | ETHER | SULFATE | MIXTURE |
|---|---|---|---|---|
| Average carbon chain Length (No. C Atoms) | I 14.86 | II 14.68 | III 14.86 | IV 14.88 |
| 12–13 carbon atoms (wt.%) | 4% | 1% | 1% | 3% |
| 14–15 carbon atoms (wt.%) | 55% | 65% | 65% | 57% |
| 16–17 carbon atoms (wt.%) | 36% | 33% | 33% | 38% |
| 18–19 carbon atoms (wt.%) | 5% | 1% | 1% | 2% |
| Average degree of ethoxylation (No. Moles EO) | 1.98 | 2.25 | 2.25 | 3.0 |
| 0 moles ethylene oxide (wt.%) | 15% | 21% | 22.9% | 18% |
| 1–4 moles ethylene oxide (wt.%) | 63% | 59% | 65% | 55% |
| 5–8 moles ethylene oxide (wt.%) | 21% | 17% | 12% | 22% |
| 9+ moles ethylene oxide (wt.%) | 1% | 3% | 0.1% | 5% |
| Salt | K | Na | Na | Na |

Preferred "olefin sulfonate" detergent mixtures utilizable herein comprise olefin sulfonates containing from about 10 to about 24 carbon atoms. Such materials can be produced by sulfonation of $\alpha$-olefins by means of uncomplexed sulfur dioxide followed by neutralization under conditions such that any sultones present are hydrolyzed to the corresponding hydroxyalkane sulfonates. The $\alpha$-olefin starting materials preferably have from 14 to 16 carbon atoms. Said preferred $\alpha$-olefin sulfonates are described in U.S. Pat. No. 3,332,880, incorporated herein by reference.

Preferred $\alpha$-olefin sulfonate mixtures herein consist essentially of from about 30 to about 70% by weight of a Component A, from about 20 to about 70% by weight of a Component B, and from about 2 to about 15% of a Component C, wherein a. said Component A is a mixture of double-bond positional isomers of water-soluble salts of alkene-1-sulfonic acids containing from about 10 to about 24 carbon atoms, said mixture of positional isomers including about 10 to about 25% of an alpha-beta unsaturated isomer, about 30 to about 70% of a beta-gamma unsaturated isomer, about 5 to about 25% of gamma-delta unsaturated isomer, and about 5 to about 10% of a delta-epsilon unsaturated isomer;

b. said Component B is a mixture of water-soluble salts of bifunctionally-substituted sulfur-containing saturated aliphatic compounds containing from about 10 to about 24 carbon atoms, the functional units being hydroxy and sulfonate groups with the sulfonate groups always being on the terminal carbon and the hydroxyl group being attached to a carbon atom at least two carbon atoms removed from the terminal carbon atoms at least 90% of the hydroxy group substitutions being in 3, 4, and 5 positions; and c. said Component C is a mixture comprising from about 30–95% water-soluble salts of alkene disulfonates containing from about 10 to about 24 carbon atoms, and from about 5 to about 70% water-soluble salts of hydroxy disulfonates containing from about 10 to about 24 carbon atoms, said alkene disulfonates containing a sulfonate group attached to a terminal carbon atom and a second sulfonate group attached to an internal carbon atom not more than about six carbon atoms removed from said terminal carbon atom, the alkene double bond being distributed between the terminal carbon atom and about the seventh carbon atom, said hydroxy disulfonates being saturated aliphatic compounds having a sulfonate group attached to a terminal carbon, a second sulfonate group attached to an internal carbon atom not more than about six carbon atoms removed from said terminal carbon atom, and a hydroxy group attached to a carbon atom which is not more than about four carbon atoms removed from the site of attachment of said second sulfonate group.

Optional Additives

The detergent compositions of the present invention can contain, in addition to the silicone and detergent, water-soluble builders such as those commonly taught for use in detergent compositions. Such auxiliary builders can be employed to sequester hardness ions and to help adjust the pH of the laundering liquor. Such builders can be employed in concentrations of from about 5 to about 95% by weight, preferably from about 10 to about 50% by weight, of the detergent compositions herein to provide their builder and pH-controlling function. The builders herein include any of the conventional inorganic and organic water-soluble builder salts.

Such builders can be, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane-1-hydroxy-1, 1-diphosphonic acid and the sodium and potassium salts of ethane-1, 1,2-triphosphonic acid. Examples of these and other phosphorus builder compounds are disclosed in U.S. Pat. Nos. 3,159,581, 3,213,030, 3,422,021, 3,422,137 3,400,176 and 3,400,148, incorporated herein by reference.

Non-phosphorus containing sequestrants can also be selected for use herein as builders.

Specific examples of non-phosphorus, inorganic detergent builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful in the present compositions. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorus auxiliary builder materials herein include sodium carbonate, sodium bicarbonate, sodium silicate, sodium citrate, sodium oxydisuccinate, sodium mellitate, sodium nitrilotriacetate, and sodium etnylenediaminetetraacetate, and mixtures thereof.

Other highly preferred builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phlorogiucinol trisulfonate.

The detergent compositions herein can contain all manner of additional materials commonly found in laundering and cleaning compositions. For example, the compositions can contain thickeners and soil suspending agents such as carboxymethylcellulose and the like. Enzymes, especially the proteolytic and lipolytic enzymes commonly used in laundry detergent compositions, can also be present herein. Various perfumes, optical bleaches, fillers, anti-caking agents, fabric softeners and the like can be present in the compositions to provide the usual benefits occasioned by the use of such materials in detergent conditions. Polyethylene glycol (M.W. 600–8000), especially polyethylene glycol 6000, can be advantageously used in the fabric laundery compositions herein at from 0.1 to 1.5% by weight to provide whiteness maintenance benefits. It is to be recognized that all such adjuvant materials are useful herein inasmuch as they are compatible and stable in the presence of the isolated silicone suds suppressor.

The composition herein can additionally contain from 0.1 to 10% by weight of one or more bleaching agents. Preferred bleaching agents are hydrogen peroxide addition compounds. The hydrogen peroxide addition compounds may be organic but are preferabyl inorganic in nature.

A great variety of these compounds exist. Most of them are prepared by crystallization from solutions containing $H_2O_2$. Others are prepared by drying a slurry containing the corresponding salts and $H_2O_2$. The most useful hydrogen peroxide addition compounds are the perborates, e.g., sodium perborate mono- and tetrahydrates. Other useful perborates are potassium and ammonium perborates having the formulae $2KBO_3 \cdot H_2O$ and $2NH_4BO_3 \cdot H_2O$ respectively. Other valuable hydrogen peroxide addition compounds are the carbonate peroxyhydrates, e.g., $2Na_2CO_3 \cdot 3H_2O_2$, and the phosphate peroxyhydrates, e.g., sodium pyrophosphate peroxyhydrate $Na_4P_2O_7 \cdot 2H_2O_2$. The most suitable organic hydrogen peroxide addition compound which can be incorporated into the detergent compositions of the present invention is the urea hydrogen peroxide addition compound of the formula $CO(NH_2)_2 \cdot H_2O_2$, because it is one of the few free flowing dry organic hydrogen peroxide addition compounds.

Other bleaching agents which can be used include oxygenating bleaches such as sodium or potassium persulfate, for instance the mixed salt marketed as "Oxone", and organic per acids and peroxides, such as those disclosed in British Pat. Nos. 886,188, 1,293,063 and British Application No. 5896/71.

Halogen bleaches, for example hypochlorites or hypobromites and compounds providing these ions in solution, may also be used in the compositions herein. Examples are sodium hypochlorite itself, chlorinated trisodium phosphate, and organic N-chloro-compounds such as chlorinated isocyanuric acid compounds. These are particularly useful in automatic dishwashing detergent compositions at concentrations of from 0.1to 10% by weight.

A finished detergent composition of this invention may contain minor amounts of materials which make the product more attractive. The following are mentioned by way of example: a tarnish inhibitor such as benzotriazole or ethylene thio-urea can be added in amounts up to 2% by weight; fluorescers, perfumes and dyes, while not essential, can be added in small amounts. An alkaline material such as sodium or potassium carbonate or hydroxide can be added in minor amounts as supplementary pH adjusters. There may also be mentioned, as suitable additives: bacteriostats, bactericides, corrosion inhibitors such as soluble alkali silicates (preferably sodium silicates having an $SiO_2$/-$Na_2O$ ratio of from 1:1 to 2.8:1, and textile softening agents.

The following examples illustrate the compositions herein, but are not intended to be limiting thereof.

EXAMPLE 1

A granular detergent composition having the following composition by weight was used in this illustration of the invention:

| | |
|---|---|
| Sodium salt of linear dodecylbenzene sulphonate | 10% |
| Tallow alcohol condensed with 11 molar proportions of ethylene oxide | 2% |
| Sodium tripolyphosphate | 32% |
| Sodium perborate tetrahydrate | 32% |
| Sodium silicate | 6% |
| Sodium sulphate | 6% |
| Moisture etc. | balance. |

To samples of this composition were added 0.1% by weight of silanated silica (QUSO WR50 supplied by Philadelphia Quartz Co.) and 0.1% by weight of silicone (SAG 100 supplied by Union Carbide Corp.), in various forms as described below. The sudsing behaviour of these compositions was tested in a miniature drum washing machine, loaded with 0.875 g of a lipid soil, and a standard load of fabric. The washing liquor consisted of 3.5 liters of a solution of the composition to be tested, of concentration 0.9% by weight, in water hardness of 3.4 millimols per liter, at 25°C initially. The machine was started and the temperature of the solution raised to 90°C over a period of 1 hour. Suds levels were measured at appropriate temperature levels. Suds heights observed are given below.

| SAMPLE | Temperature<br>Agitation Time | 30°C<br>6–7 mins. | 90°C<br>60 mins. |
|---|---|---|---|
| (1) | No suds control agent | 15 cm | Oversudsing |
| (2) | Silicone/Silanated silica incorporated in detergent composition before spray drying | 15 cm | Oversudsing |
| (3) | Silicone/Silanated mixture, unprotected, blended with granular composition | | |
| | (a) Immediately before testing | 0 | 8 cm |
| | (b) Product prepared and aged 1 month before testing | 15 cm | Oversudsing |
| (4) | Silicone and silanated silica components dry mixed separately with the granular composition | 0 cm | 10 cm |
| (5) | Mixed silicone/silanated silica granulated and coated with $TAE_{25}$ and then dry mixed with the granular detergent composition. | | |
| | (a) Immediately before testing | 5 cm | 8 cm |
| | (b) Product prepared and aged 1 month before testing | 5 cm | 8 cm |

EXAMPLE 2

A composition, differing from that of Example 1 in that it contained 12% by weight of TERGITOL 15-S-9 (a $C_{10-15}$ secondary alcohol ethoxylated with an average of 9 moles ethylene oxide) instead of the dodecylbenzene sulphonate and tallow alcohol ethoxylate, was tested similarly.

Suds levels were:

| SAMPLE | Temperature<br>Agitation Time | 30°C<br>6–7 mins | 90°C<br>60 mins |
|---|---|---|---|
| (1) | No suds control agent | 10 cm | Oversudsing |
| (2) | Silicone/Silanated silica components dry mixed separately with the granular composition | 0 cm | 8 cm |
| (3) | Mixed silicone/silanated silica granulated, and coated with $TAE_{25}$ and then dry mixed with the granular detergent composition | | |
| | (a) Immediately before testing | 5 cm | 6 cm |
| | (b) Product prepared and aged 1 month before testing | 5 cm | 6 cm |

Example 1 (Sample 5) and Example 2 (Sample 3) clearly illustrate the comparative storage stability of detergent compositions containing the suds control agent protected from interaction with the detergent.

Example 3 demonstrates the controlled suds profile which is achieved by means of mixed silanated silica/-silicone suds controlling agents incorporated in $TAE_{25}$.

EXAMPLE 3

Detergent compositions formulated as follows were prepared:

| | A | B | C | D |
|---|---|---|---|---|
| TERGITOL 15-S-9 | 10% | 10% | 10% | 10% |
| Sodium tripolyphosphate (STPP) | 40% | 40% | 40% | 40% |
| Sodium perborate tetrahydrate | 25% | 25% | 25% | 25% |
| Sodium silicate ($SiO_2 : Na_2O = 2.0$) | 8% | 8% | 8% | 8% |
| Sodium sulfate | 7% | 7% | 7% | 7% |
| Silanated silica | 0.1% | — | 0.1% | 0.05% |
| Silicone | — | 0.1% | 0.1% | 0.05% |
| Tallow alcohol ethoxylated with an average of 25 moles ethylene oxide ($TAE_{25}$) | — | — | 0.8% | 0.4% |
| Balance (water, perfume proteolytic enzyme, optical brightener, and sodium carboxymethylcellulose) | | | | |

TERGITOL 15-S-9, silanated silica, and silicone are more precisely defined in Examples 1 and 2.

The above compositions were prepared by a spray-drying process with the perborate, silanated silica and-/or silicone dry-blended into the spray-dried portion. The liquid silicone of Composition B was first sprayed onto a bed of STPP to form agglomerates and then added to the spray-dried portion of the composition. The silanated silica and silicone of Compositions C and D were first blended with melted $TAE_{25}$. This blend was then atomized into a fluidized bed of STPP to form agglomerates. The agglomerates are of a spherical shape with the silanated silica, silicone and $TAE_{25}$ homogeneously blended together and having a coating of STPP. The agglomerate consisted of about 5% silanated silica, 5% silicone, 40% $TAE_{25}$ and 50% STPP. They had a particle size of about 0.25 to 1.50 mm diameter as determined by sieve analysis.

Compositions A–D were tested for sudsing by adding sufficient product to a washing machine containing 3.5 liters of water having a water hardness of 3.0 mmol/-liter to give a product concentration of 0.8% by weight. The washing machine contained lipid soil as well as soiled clothing. The water was heated from 20° to 100°C over a time span of 1 hour. The height of the suds was measured at different temperature levels and recorded. A level of suds above 15 cm for this type of washing machine is unacceptable in that proper cleaning is impaired. Each composition was tested in the same manner. Results of the tests were as follows:

| | 30°C | 40°C | 50°C | 60°C | 70°C | 80°C | 90°C |
|---|---|---|---|---|---|---|---|
| Composition A | 8 cm | 14 cm | 20 cm | 25 cm | — oversudsing — | | |
| Composition B | 0 cm | 0 cm | 2 cm | 10 cm | 12 cm | 11 cm | 11 cm |
| Composition C | 2 cm | 8 cm | 8 cm | 8 cm | 9 cm | 9 cm | 8 cm |
| Composition D | 6 cm | 12 cm | 12 cm | 12 cm | 11 cm | 13 cm | 12 cm |

The above results indicate that silanated silica alone (Composition A) is not a satisfactory suds suppressor in a nonionic detergent composition because of the high sudsing and oversudsing that occurs at the higher temperatures. Similarly the results obtained from Composition B indicate that the use of silicone alone in a nonionic detergent composition is not fully satisfactory because of the undesirable low suds profile at the lower temperatures. Compositions C and D possess satisfactory suds profiles as evidenced by the relatively high suds profile at low temperatures as well as effective suds suppression ability at the higher temperatures.

Example 4 demonstrates the added advantages for the use of intimate mixtures of silanated silica and silicone as suds suppressors in fabric laundering compositions.

EXAMPLE 4

The following detergent compositions were prepared:

| | A | B |
|---|---|---|
| Sodium salt of linear dodecyl benzene sulfonate | 6.3% | 6.3% |
| Sodium salt of sulfonated tallow alcohol | 2.7% | 2.7% |
| Tallow alcohol ethoxylated with an average of 11 moles of ethylene oxide ($TAE_{11}$) | 2.7% | 2.7% |
| Sodium tripolyphosphate | 40% | 40% |
| Sodium perborate tetrahydrate | 24.5% | 24.5% |
| Sodium silicate ($SiO_2 : Na_2O = 2.0$) | 9.0% | 9.0% |
| Sodium sulfate | 7.0% | 7.0% |
| Silanated silica | 0.1% | — |
| Silicone | 0.1% | — |
| Silanated silica/silicone | — | 0.2% |
| Tallow alcohol ethoxylated with an average of 25 moles of ethylene oxide ($TAE_{25}$) | 0.8% | 0.8% |
| Balance (water, perfume, sodium carboxymethylcellulose) | | |

The silanated silica and silicone were the materials described in Example 1.

Compositions A and B were prepared by a spray-drying process with the sodium perborate tetrahydrate, silanated silica, and silicone dry-mixed into the spray-dried compositions. The silanated silica and silicone of Composition A were each separately encapsulated with $TAE_{25}$. The suds suppressor mixture of Composition B was prepared in the manner described in Example 3 and had a 1:1 weight ratio of the silanated silica and silicone. The sudsing patterns of the above compositions were determined using the test described above in Example 3 except that the water used in this example has a hardness of 3.4 mmol/liter. The following results were obtained:

| | 40°C | 50°C | 60°C | 70°C | 80°C | 90°C |
|---|---|---|---|---|---|---|
| Composition A | 0 cm | 8 cm | 15 cm | 22 cm | oversudsing | |
| Composition B | 3 cm | 7 cm | 7 cm | 7 cm | 7 cm | 8 cm |

The above test shows that the sudsing pattern of the composition illustrative of this invention i.e. Composition B possesses a relatively high suds pattern at the lower temperatures but does not oversuds at the higher temperatures. However, the composition containing silanated silica and silicone separately protected possessed an unsatisfactory suds pattern for this use. More specifically, Composition A was found to oversuds at the higher temperatures. This example shows that mixtures of silanated silica and silicone which have been protected separately are not satisfactory in this type of product.

EXAMPLE 5

The following detergent composition was tested in hard water and soft water to demonstrate the fact that the suds control agent of this invention is not dependent on the hardness of the water:

| | % |
|---|---|
| TERGITOL 15-S-9 | 10 |
| Sodium tripolyphosphate | 40 |
| Sodium perborate tetrahydrate | 25 |
| Sodium silicate ($SiO_2$:$Na_2O$ = 2.0) | 8 |
| Sodium sulfate | 7 |
| Silanated silica | 0.15 |
| Silicone | 0.10 |
| Tallow alcohol ethoxylated with an average of 25 moles ethylene oxide | 1.0 |
| Balance (water, perfume, proteolytic enzyme and sodium carboxymethylcellulose) | |

The silanated silica, silicone (both as described in Example 1) and $TAE_{25}$ were as described in Example 3. The composition was tested in water solutions having hardness of 0 and 2 mmol/liter, respectively. Each test was run using a horizontal drum washing machine having a heat-up time of 1 hour from 20°to 90°C. A washing load was made up of 4.5 kg of soiled fabrics and a product concentration of 0.90%. The height of suds was measured at 4 minute intervals. The suds profiles as measured by the suds height data for the tests using the soft and hard water were substantially identical, thus indicating that the suds control agent of this invention is insensitive to water hardness. This is to be contrasted with prior art suds control agents e.g. fatty acid mixtures which control suds to varying degrees depending on the water hardness of the wash water.

EXAMPLE 6

Detergent compositions containing relatively high levels of surface-active agents were tested using the suds control agent of this invention and a known suds control agent, i.e. HYFAC (a fatty acid mixture commercially available).

| | A | B |
|---|---|---|
| Sodium salt of dodecyl benzene sulfonate | 14% | 14% |
| Tallow alcohol ethoxylated with 11 moles of ethylene oxide | 8% | 8% |
| Sodium tripolyphosphate | 28% | 28% |

-continued

| | A | B |
|---|---|---|
| Sodium perborate monohydrate | 22% | 22% |
| Sodium silicate ($Si_2O$:$Na_2O$ = 2.0) | 5% | 5% |
| Sodium sulfate | 17% | 17% |
| Silicone/silanated silica | 0.25% | — |
| Tallow alcohol ethoxylated with 25 moles of ethylene oxide | 1.0% | — |
| Hyfac | — | 5% |
| Balance (water, optical brightener, perfume and sodium carboxymethylcellulose) | | |

The silanated silica and silicone were in a 3:2 weight ratio and were the materials described in Example 1. The mixture was prepared as described in Example 3, Compositions C and D.

Each of the above compositions was tested for sudsing in a horizontal drum type washing machine. Water having a hardness of about 1 mmol was used. Detergent compositions sufficient to give a product concentration of 0.9% was added to each machine. An 8 kg bundle of soiled fabrics was split in half and also added to each machine. The wash water solutions were heated from 20° to 90°C over a heat-up time of 1 hour. The height of suds was measured at 4 minutes intervals.

The washing machine containing composition B had about 19 cm of suds at its maximum. This was considered unsatisfactory in that the cleaning performances of such a product would be impaired. However, the composition of this invention, Composition A exhibited satisfactory sudsings in that the maximum height of the generated suds was about 6 cm — too low to interfere with the cleaning action of the wash solution.

EXAMPLE 7

The composition of Example 1 (5) is modified by removal of the sodium linear $C_{12}$ alkylbenzenesulfonate and replacing it with an equal amount of the detergent mixtures set forth in Table I, respectively, and equivalent results are secured.

EXAMPLE 8

The composition of Example 1 (5) is modified by removal of the sodium linear $C_{12}$ alkylbenzenesulfonate and replacing it with an equal amount of: triethanolamine $C_{10}$–$C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkylammonio)-2-hydroxypropane-1-sulfonate; 3-(N,N-dimethyl-N-coconutalkylammonio)-propane-1-sulfonate; 6-(N-dodecylbenzyl-N,N-dimethylammonio) hexanoate; dodecyl dimethyl amine oxide; coconut alkyl dimethyl amine oxide; and mixtures thereof, respectively, and equivalent results are secured.

The controlled sudsing compositions of this invention can be used in granular detergent compositions for use in automatic dishwashing machines. For this application, low sudsing throughout a broad temperature range is desirable to prevent an overflow of suds and to insure effective operation of the machine. The use of a surface active detergent in an automatic dishwashing composition assist soil removal and facilitates sheeting of water from the soiled articles thereby inhibiting the formation of visible spots and streaks on glassware. However, the high degree of water agitation present in an automatic dishwashing machine generally produces copious sudsing even with low levels of surface active agent unless a suds control agent is present. Additionally, certain soils such as egg residues accentuate the sudsing of the detergent compositions. Indeed, the suds problem in automatic dishwashers can be so severe as to actually inhibit the rotation of the spray arm in the machine. Accordingly, low sudsing detergents are preferred for such use.

Silicone is an effective suds control agent for use in automatic dishwashing machines. The presence of silicone in the washing solution during the wash cycle of an automatic dishwasher in the range of 0.1 to 1% based on the weight of granular detergent compositions is effective in controlling the suds of a granular detergent composition containing 10% by weight of a nonionic surface active agent such as an ethoxylated fatty alcohol containing an average of about 6 moles of ethylene oxide for each mole of fatty alcohol with an average of about 12 carbon atoms. Although silicone has shown the potential to control suds in such a composition, the simple incorporation of silicone into the composition itself by direct addition of silicone has not proven to be practically effective. As noted above, aged or stored conventional silicone-containing detergent compositions lose their sudsing characteristics and become unacceptable for use in automatic dishwashing machines. The addition of silicone to a granular carrier such as sodium silicate or sodium tripolyphosphate before incorporation into the remainder of the detergent composition does not prevent the loss of a low sudsing characteristic as a consequence of aging. Compositions prepared as described herein overcome these sudsing/aging problems and provide detergent compositions especially adapted for use in automatic dishwashers.

EXAMPLE 9

A granular composition especially adapted for use in an automatic dishwasher is as follows:

| Component | Wt.% |
|---|---|
| Anhydrous Sodium Carbonate | 30.0 |
| Hydrated Sodium Silicate (81.5% solids, $SiO_2.Na_2O$ ratio = 2.1:1 by weight) | 20.0 |
| Coconut alcohol condensed with 6 molar proportions of ethylene oxide | 10.0 |
| Sodium citrate dihydrate | 10.0 |
| Sodium dichlorocyanurate dihydrate | 3.8 |
| Polyethylene glycol (Carbowax 4000 M.W. 3000–3700) | 2.0 |
| Dimethyl Silicone | 0.8 |
| Anhydrous Sodium Sulfate | Balance |

The foregoing composition was prepared by mixing the sodium carbonate, the sodium citrate, the sodium dichlorocyanurate, the sodium sulfate, and one-half of the sodium silicate in a ribbon blender. The ethoxylated fatty alcohol was sprayed on these granules. Separately, the remaining silicate was charged into a second ribbon blender. The fluid silicone (SAG 100) was added thereto and mixed with the silicate until uniformly dispersed. The polyethylene glycol was melted at 140°F and the melt was sprayed over the silicone-silicate granules. Continued blending during the spraying process insured a substantially uniform coating of solid polyethylene glycol on the silicone-silicate granules. The two granule portions from the first and second ribbon blenders were dry-mixed together.

The sudsing behavior of this composition was evaluated in a Hobart Kitchen Aid Model KD-15C automatic dishwashing machine. For purposes of evaluating the sudsing characteristics of a detergent composition, conditions known to accentuate sudsing are employed. The machine was loaded with clean dishes and glassware. Fifteen grams of blended raw egg were placed in the machine. A source of softened water (less than 1 grain/gal. of Ca as $Ca\ Co_3$) was connected to the water inlet part of the washer. Twenty-five grams of the detergent composition were added to the machine and the machine cycle was started. Water temperature for the wash and rinse cycles was maintained at 100°–105°F.

Sudsing is measured by observing suds overflow from the top of the machine. This occurrence is very objectionable. Excessive suds also manifests itself by slowing down the rotation of the spray arm of the washer. The degree of slowdown is measured by equipping the machine with a rotation counter and can be expressed relative to the rotation speed when no detergent is present in the machine. The sudsing behavior of the composition listed was evaluated immediately after preparation of the composition and also after the product was maintained in a vapor tight container for four days at 100°F.

Performance results were as follows:

| | Freshly Made Product | Aged 4 Days 100°F |
|---|---|---|
| Suds Overflow | None | None |
| Machine Efficiency (no product = 100%) | | |
| Wash cycle | 87.6% | 90.1% |
| First Rinse | 83.4 | 86.2 |
| Second Rinse | 86.1 | 87.6 |

The above results indicate that the composition is a satisfactory automatic dishwasher detergent composition from the standpoint of sudsing and that aging at elevated temperatures does not cause a loss of suds control capabilities.

If the composition used in this demonstration is modified by using an unprotected dimethyl silicone suds controlling agent, the machine efficiency figures in the right hand column of the table above would be significantly below the values obtained with freshly made product.

The detergent compositions herein are conveniently prepared by simply dry-mixing the various components.

By this invention detergent compositions are provided which have unexpectedly improved sudsing characteristics. A discovery has been made which permits a person skilled in the art to formulate detergent compositions having reduced or nil-sudsing properties. Such detergent compositions are especially needed in automatic dishwasher applications and comprise a silicone suds controller protected or insulated from contact with the major surface active detergent component of the total formulation. For light-duty or heavy-duty laundry applications, the present invention, in a preferred embodiment, provides compostions which have an overall suds profile acceptable at lower temperatures (hand laundering) or higher temperatures (machine laundering). This latter preferred embodiment comprises silicone used in conjunction with at least one additional essential element which together are protected from the degradative influence of a surface active detergent.

What is claimed is:

1. A detergent composition having a controlled suds pattern consisting essentially i. from about 0.01 to about 10% by weight of a suds controlling agent comprising an intimate mixture of silicone and silica having a surface area greater than 50 $m^2$/gram releaseably incorporated in a water-soluble or water-dispersible, substantially non-surface active, detergent-impermeable carrier selected from the group consisting of gelatin, agar, gum arabic, algae gel and the condensation products of tallow alcohol and 25 moles or more of ethylene oxide; and from about 5 to about 95% by weight of a detergent component selected from the group consisting of anionic, nonionic, zwitterionic, ampholytic and cationic detergent compound;

wherein the silicone is in a weight ratio to the silica of from about 19:1 to about 1:2 and the carrier is from about 0.1 to about 99% by weight of the suds controlling agent and the carrier material.

2. A composition according to claim 1 wherein the suds controlling agent is a polydimethylsiloxane fluid.

3. A composition according to claim 1 wherein the silica is hydrophobic.

4. A composition according to claim 3 wherein the hydrophobic silica is silanated silica.

5. A composition according to claim 4 wherein the silicone is a polydimethylsiloxane fluid.

6. A composition according to claim 1 wherein the silicone is sorbed onto and into a member selected from the group consisting of sodium carbonate, sodium tripolyphosphate, sodium silicate, clay, starch, kieselguhr, and Fuller's Earth.

7. A composition according to claim 1 wherein the suds controlling agent is a mixture of silicone fluid, silicone resin and silica comprising:

a. from about 10 parts to about 100 parts by weight of a polydimethylsiloxane fluid having a viscosity in the range from 20 cs. to 1500 cs at 25°C;

b. 5 to 50 parts by weight of a siloxane resin composed of $(CH_3)_3SiO_{1/2}$ units and $SiO_2$ units in which the ratio of the $(CH_3)_3SiO_{1/2}$ units to the $SiO_2$ units is within the range of from 0.6/1 to 1.2/1; and c. 1 to 10 parts by weight of a silica aerogel.

8. A composition according to claim 7 wherein the mixture is sorbed on a water-soluble solid selected from the group consisting of sodium carbonate, sodium tripolyphophate, sodium silicate, clay, starch, kieselguhr, and Fuller's Earth.

9. A composition according to claim 1 wherein the suds controlling agent is additionally coated with a member selected from the group consisting of sodium tripolyphosphate, sodium carbonate, sodium carboxymethylcellulose, granulated starch, clay, sodium citrate, sodium acetate, and sodium sulfate in a weight ratio of the suds controlling agent to said member of from about 20:1 to about 1:20.

10. A composition according to claim 1 wherein the detergent compound is a water-soluble salt of an organic sulfuric reaction product having in its molecular structure an alkly group containing from about 8 to about 22 carbon atoms and a sulfonic acid or sulfuric acid ester group.

11. A composition according to claim 1 wherein the detergent compound is a water-soluble soap.

12. A composition according to claim 1 wherein the detergent compound is selected from the group consisting of sodium linear $C_{10}$ –$C_{18}$ alkyl benzene sulfonate; triethanolamine $C_{10}$ 14 $C_{18}$ alkyl benzene sulfonate; sodium tallow alkyl sulfate; sodium coconut alkyl glyceryl ether sulfonate; the sodium salt of a sulfated condensation product of a tallow alcohol with from about 3 to about 10 moles of ethylene oxide; the condensation product of a coconut fatty alcohol with about 6 moles of ethylene oxide; the condensation product of tallow fatty alcohol with about 11 moles of ethylene oxide; 3-(N,N-dimethyl-N-coconutalkyl-ammonio) -2-hydroxypropane-1-sulfonate; 3-(N,N-dimethyl-N-coconutalkylammonio) -propane-1-sulfonate; 6-(N-dodecylbenzyl-N,N-dimethylammonio) hexanoate; dodecyl dimethyl amine oxide; coconut alkyl dimethyl amine oxide; the water-soluble sodium and potassium salts of higher fatty acids containing 8 to 24 carbon atoms; and mixtures thereof

13. A composition according to claim 1 wherein the detergent compound is a mixture of alkyl ether sulfate compounds, comprising: from about 0.05 to 5% by weight of mixture of $C_{12-13}$ compounds, from about 55 to 70% by weight of mixture of $C_{14-15}$ compounds, from about 25 to 40% by weight of mixture of $C_{16-17}$ compounds, from about 0.1 to 5% by weight of mixture of $C_{18-19}$ compounds, from about 15 to 25% by weight of mixture of compounds having a degree of ethoxylation of 0, from about 50 to 65% by weight of mixture of compounds having a degree of ethoxylation from 1 to 4, from about 12 to 22% by weight of mixture of compounds having a degree of ethoxylation from 5 to 8 and from about 0.5 to 10% by weight of mixture of compounds having a degree of ethoxylation greater than 8.

14. A composition according to claim 1, containing, as an additional component, from about 5 to about 95% by weight of a water-soluble detergency builder.

15. A composition according to claim 14 wherein the auxiliary builder is selected from the group consisting of sodium tripolyphosphate and potassium tripolyphosphate.

16. A composition according to claim 14 wherein the auxiliary builder is a non-phosphorus containing builder.

17. A composition according to claim 16 wherein the detergency builder is selected from the group consisting of water-soluble inorganic carbonate, bicarbonate, and silicate salts.

18. A composition according to claim 16 wherein the detergency builder is selected from the group consisting of sodium citrate, sodium oxydisuccinate, sodium mellitate, sodium nitrilotriacetate, sodium ethylenediaminetetraacetate, sodium polymaleate, sodium polyitaconate, sodium polymesaconate, sodium polyfumarate, sodium polyaconitate, sodium polycitraconate, sodium polymethylenemalonate, sodium carboxymethylmalonate, sodium carboxymethyloxysuccinate, sodium cis-cyclohexanehexacarboxylate, cis-cyclopentanetetracarboxylate and sodium phloroglucinol trisulfonate.

19. A composition according to claim 1 containing as an additional component from about 0.1 to about 3% by weight of a polyethylene glycol of a molecular weight in the range of 400 to 8,000.

20. A composition according to claim 19 containing from 0.5 to 1.5% of polyethylene glycol of a molecular weight of 6,000.

21. The detergent composition of claim 1 wherein the carrier is a condensation product of tallow alcohol and about 25 moles of ethylene oxide.

22. The composition of claim 21 wherein the detergent component is a nonionic surface active agent.

* * * * *

UNITED STATES PATENT OFFICE

CERTIFICATE OF CORRECTION

PATENT NO. : 3,933,672

DATED : January 20, 1976

INVENTOR(S) : Guiseppe Bartolotta; Nicolaas Tieme de Oude; Alfred Alexander Gunkel It is certified that error appears in the above-identified patent and that said Letters Patent are hereby corrected as shown below:

Column 6, line 39, "agnets" should be -- agents --.
Column 9, line 31, "or" should be -- of --.
Column 9, line 67, "easily" should be -- readily --.

Column 14, line 37, "phlorogiucinol" should be -- phloroglucinol --.
Column 14, line 51 "conditions" should be -- compositions --

Column 21, line 29, before "sudsing" insert -- low --.
Claim 1, line 2, after "essentially" insert -- of --.
Claim 1, line 13, before "from" insert -- (ii) --.
Claim 8, line 4, "tripolyphophate" should read -- tripolyphosphate --.
Claim 10, line 4, "alkly" should be -- alkyl --.
Claim 12, line 4, delete "14" after "$C_{10}$" and insert a dash -- - --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*